US011937720B1

(12) United States Patent
Jiang

(10) Patent No.: US 11,937,720 B1
(45) Date of Patent: Mar. 26, 2024

(54) HAT ORGANIZER

(71) Applicant: Xiaoxi Jiang, Qiqihar (CN)

(72) Inventor: Xiaoxi Jiang, Qiqihar (CN)

( * ) Notice: Subject to any disclaimer, the term of this patent is extended or adjusted under 35 U.S.C. 154(b) by 0 days.

(21) Appl. No.: 18/446,077

(22) Filed: Aug. 8, 2023

Related U.S. Application Data

(63) Continuation-in-part of application No. 29/885,324, filed on Feb. 23, 2023, now Pat. No. Des. 993,661.

(51) Int. Cl.
*A47G 25/10* (2006.01)

(52) U.S. Cl.
CPC ..... *A47G 25/10* (2013.01)

(58) Field of Classification Search
CPC .. A47G 25/10; A42B 1/00; A42B 1/16; A47F 7/06; D06C 5/00
USPC ..... D6/315, 317, 320, 327
See application file for complete search history.

(56) References Cited

U.S. PATENT DOCUMENTS 797,833 A * 8/1905 Anderson ..... A47F 7/06 211/33
2,490,508 A * 12/1949 Delgatto ..... A42B 1/002 223/84
2,555,348 A * 6/1951 Lev ..... A42B 1/0181 2/209.7
5,172,837 A * 12/1992 Finney, Jr. ..... A42B 1/002 223/66
D364,074 S * 11/1995 Yeh ..... D7/637
5,566,837 A * 10/1996 Lema ..... A47F 7/06 211/32
5,813,546 A * 9/1998 Wilson ..... A47F 7/06 D9/632
5,845,778 A * 12/1998 Hickey, Jr. ..... B65D 75/36 206/8
6,125,997 A * 10/2000 Campbell ..... A45C 11/02 206/8
8,220,673 B1 * 7/2012 Levin ..... A42B 1/002 223/66
D921,404 S * 6/2021 Kurlander ..... D6/678.4

* cited by examiner

*Primary Examiner* — Ismael Izaguirre
(74) *Attorney, Agent, or Firm* — Daniel M. Cohn; Howard M. Cohn

(57) ABSTRACT

A hat organizer is configured to hold at least one baseball cap and is mounted on a mounting surface of a mounting object. The hat organizer includes a cap body limiting portion. The hat organizer defines a cap body accommodating space. The cap body limiting portion is disposed around the mounting surface of the mounting object to form the cap body accommodating space. The cap body accommodating space is configured to accommodate a cap body of the at least one baseball cap. The cap body limiting portion is configured to limit the cap body. The cap body limiting portion forms an inner surface of the cap body accommodating space. A radian of the inner surface of the cap body accommodating space is matched with a radian of an outer surface of a dome of the cap body to prevent the cap body from deformation.

14 Claims, 8 Drawing Sheets

HAT ORGANIZER

TECHNICAL FIELD

The present disclosure relates to a field of display technology, and in particular to a hat organizer.

BACKGROUND

In the prior art, an apparatus for supporting or hanging clothes and hats is generally known as a hat rack. The hat rack generally comprises a hat rack support rod and a plurality of hooks disposed on the hat rack support rod for hanging the clothes or the hats.

A user may hang the hats, such as baseball caps, on the plurality of hooks of the hat rack respectively. The baseball caps each generally comprises a cap body and a brim disposed on an edge of the cap body, and a dome is generally disposed a position where the cap body and the brim are fixedly connected. In general, a hardness of the dome is generally slightly greater than a hardness of the cap body, and a hardness of the brim is greater than the hardness of the dome.

In practical application, because weight design of each part of the baseball caps is different, when the user hangs up the baseball caps, the cap body of each of the baseball caps is generally hung on a corresponding hook, and a hanging part thereof is often opposite to the brim. If the baseball caps are hung on the plurality of hooks of the hat rack for a long time, the dome of each of the baseball caps is easily deformed, and more seriously, the brim of each of the baseball caps may deform. In addition, in practical applications, different users may have different numbers of the baseball caps, and when a plurality of baseball caps have to be hung on a same hook, the plurality of baseball caps are stacked and hung on one of the plurality of hooks of the hat rack. Due to the gravity effect, domes of the plurality of baseball caps are easily deformed, and more seriously, the brims of the plurality of baseball caps are deformed.

SUMMARY

The present disclosure provides a hat organizer that well supports cap bodies of base caps placed therein.

The hat organizer is configured to hold at least one baseball cap on a mounting surface of a mounting object. The hat organizer comprises a brim limiting portion and a cap body limiting portion fixedly connected to the cap body limiting portion.

The hat organizer defines a brim accommodating space and a cap body accommodating space. The brim limiting portion is disposed around the mounting surface of the mounting object to form the brim accommodating space. The cap body limiting portion is disposed around the mounting surface of the mounting object to form the cap body accommodating space. The brim accommodating space is communicated with the cap body accommodating space. A space of the cap body accommodating space is greater than a space of the brim accommodating space.

The brim accommodating space is configured to accommodate a brim of the at least one baseball cap. The cap body accommodating space is configured to accommodate a cap body of the at least one baseball cap.

The brim limiting portion is configured to limit the brim. The brim limiting portion forms an inner surface of the brim accommodating space. A radian of the inner surface of the brim accommodating space is matched with a radian of an outer surface of the brim of the at least one baseball cap. When the brim of the at least one baseball cap is limited in the brim limiting portion, the inner surface of the brim accommodating space prevents the brim of the at least one baseball cap from deformation.

The cap body limiting portion is configured to limit the cap body. The cap body limiting portion forms an inner surface of the cap body accommodating space. A radian of the inner surface of the cap body accommodating space is matched with a radian of an outer surface of a dome of the cap body of the at least one baseball cap. When the cap body of the at least one baseball cap is limited in the cap body limiting portion, the inner surface of the cap body accommodating space prevents the dome of the cap body of the at least one baseball cap from deformation.

In one optional implementation, the brim limiting portion is inclined relative to the mounting surface of the mounting object. A capacity of the brim accommodating space defined by the brim limiting portion gradually reduces from one end of the brim limiting portion adjacent to the cap body limiting portion to one end of the brim limiting portion away from the cap body limiting portion.

In one optional implementation, the cap body limiting portion is inclined relative to the mounting surface of the mounting object. A capacity of the cap body accommodating space defined by the cap body limiting portion gradually increases from one end of the cap body limiting portion adjacent to the brim limiting portion to one end of the cap body limiting portion away from the brim limiting portion.

In one optional implementation, the brim limiting portion is inclined relative to the mounting surface of the mounting object. A capacity of the brim accommodating space defined by the brim limiting portion gradually reduces from one end of the brim limiting portion adjacent to the cap body limiting portion to one end of the brim limiting portion away from the cap body limiting portion. The cap body limiting portion is inclined relative to the mounting surface of the mounting object. A capacity of the cap body accommodating space defined by the cap body limiting portion gradually increases from one end of the cap body limiting portion adjacent to the brim limiting portion to one end of the cap body limiting portion away from the brim limiting portion.

In one optional implementation, the brim accommodating space is a semi-circular-boss-shaped space with the mounting surface of the mounting object. The cap body accommodating space forms a hemispherical space with the mounting surface of the mounting object.

In one optional implementation, the cap body limiting portion comprises a plurality of first cap body limiting bars. The plurality of first cap body limiting bars are transversely disposed at intervals relative to the mounting surface of the mounting object.

The brim limiting portion comprises a plurality of first brim limiting bars. The plurality of first brim limiting bars are vertically disposed at intervals relative to the mounting surface of the mounting object.

In one optional implementation, any one of the plurality of first cap body limiting bars is connected to two of the plurality of first brim limiting bars.

In one optional implementation, the hat organizer further comprises a first connecting bar. The first connecting bar is disposed on a bottom of the brim limiting portion and is fixedly connected to the brim limiting portion. An inclination of the first connecting bar relative to the mounting face of the mounting object is same as an inclination of the brim limiting portion relative to the mounting face of the mounting object.

In one optional implementation, the plurality of first brim limiting bars comprise a first sub-brim limiting bar and a second sub-brim limiting bar. The first sub-brim limiting bar and the second sub-brim limiting bar are respectively disposed on two ends of the brim limiting portion.

The hat organizer further comprises a first fixing portion and a second fixing portion. The first fixing portion is disposed on the first sub-brim limiting bar. The second fixing portion is disposed on the second sub-brim limiting bar. The first fixing portion and the second fixing portion are configured to mount the hat organizer on the mounting surface of the mounting object.

In one optional implementation, the cap body limiting portion comprises a plurality of second cap body limiting bars. The plurality of second cap body limiting bars are vertically disposed at intervals relative to the mounting surface of the mounting object.

The brim limiting portion comprises a plurality of second brim limiting bars. The plurality of second brim limiting bars are vertically disposed at intervals relative to the mounting surface of the mounting object.

In one optional implementation, any one of the plurality of second cap body limiting bars is connected to one of the plurality of second brim limiting bars.

The hat organizer further comprises a second connecting bar and a third connecting strap. The second connecting bar is disposed on a bottom of the brim limiting portion and is fixedly connected to the brim limiting portion. An inclination of the second connecting bar relative to the mounting face of the mounting object is same as an inclination of the brim limiting portion relative to the mounting face of the mounting object.

The third connecting bar is disposed on a bottom of the cap body limiting portion and is fixedly connected to the cap body limiting portion. An inclination of the third connecting bar relative to the mounting face of the mounting object is same as an inclination of the cap body limiting portion relative to the mounting face of the mounting object.

In one optional implementation, the brim limiting portion comprises a first sub-brim limiting portion and a second sub-brim limiting portion. The first sub-brim limiting portion and the second sub-brim limiting portion are fixedly connected to each other, and the first sub-brim limiting portion is configured to limit a top end of the brim of the at least one baseball cap. The second sub-brim limiting portion is configured to limit an outer surface of the brim of the at least one baseball cap.

The second sub-brim limiting portion is fixedly connected to the cap body limiting portion.

In one optional implementation, the brim limiting portion comprises a third brim limiting bar, and the cap body limiting portion comprises a third cap body limiting bar.

The hat organizer further comprises a fourth connecting bar and a fifth connecting bar. The fourth connecting bar is parallel to the mounting surface of the mounting object. The fourth connecting bar is attached to the mounting surface of the mounting object. The fifth connecting bar is perpendicular to the mounting surface of the mounting object. The cap body limiting portion is fixedly connected to the fifth connecting bar, and the cap body limiting portion is connected to a middle of the fifth connecting bar.

The first sub-brim limiting portion is fixedly connected to the fourth connecting bar. The first sub-brim limiting portion is disposed on a middle of the fourth connecting bar. Two ends of the fourth connecting bar are fixedly connected to two ends of the fifth connecting bar.

In one optional implementation, the cap body limiting portion is inclined relative to the mounting surface of the mounting object. A capacity of the cap body accommodating space defined by the cap body limiting portion gradually increases from one end of the cap body limiting portion adjacent to the brim limiting portion to one end of the cap body limiting portion away from the brim limiting portion.

The brim accommodating space forms a semi-cylindrical space with the mounting surface of the mounting object. The cap body accommodating space forms a hemispherical space with the mounting surface of the mounting object.

In one optional implementation, the cap body limiting portion comprises a plurality of fourth cap body limiting bars. The plurality of fourth cap body limiting bars are transversely disposed at intervals relative to the mounting surface of the mounting object. The brim limiting portion comprises a brim limiting plate.

A plurality of through holes spaced apart from each other are defined on the brim liming plate, or no through hole is defined on the brim liming plate.

The present disclosure further provides a hat organizer configured to hold at least one baseball cap on a mounting surface of a mounting object. The hat organizer comprises a cap body limiting portion.

The hat organizer defines a cap body accommodating space. The cap body limiting portion is disposed around the mounting surface of the mounting object to form the cap body accommodating space. The cap body accommodating space is configured to accommodate a cap body of the at least one baseball cap. The cap body limiting portion is configured to limit the cap body. The cap body limiting portion forms an inner surface of the cap body accommodating space. A radian of the inner surface of the cap body accommodating space is matched with a radian of an outer surface of a dome of the cap body of the at least one baseball cap. When the cap body of the at least one baseball cap is limited in the cap body limiting portion, the inner surface of the cap body accommodating space prevents the cap body of the at least one baseball cap from deformation.

In one optional implementation, the cap body limiting portion is inclined relative to the mounting surface of the mounting object. A capacity of the cap body accommodating space defined by the cap body limiting portion gradually increases from a bottom of the cap body limiting portion to a top of the cap body limiting portion.

In one optional implementation, the cap body accommodating space forms a hemispherical space with the mounting surface of the mounting object.

In one optional implementation, the cap body limiting portion comprises a plurality of fifth cap body limiting bars. The plurality of fifth cap body limiting bars are vertically disposed at intervals relative to the mounting surface of the mounting object.

The hat organizer further comprises a sixth connecting bar and a seventh connecting bar. The sixth connecting bar is disposed on the bottom of the cap body limiting portion and is fixedly connected to the cap body limiting portion. The seventh connecting bar is disposed on the top of the cap body limiting portion and is fixedly connected to the cap body limiting portion.

In one optional implementation, the cap body limiting portion comprises a plurality of sixth cap body limiting bars. The plurality of sixth cap body limiting bars are transversely disposed at intervals relative to the mounting surface of the mounting object.

The hat organizer further comprises an eighth connecting bar and a ninth connecting bar. The eighth connecting bar is disposed on a first side of the cap body limiting portion and is fixedly connected to the first side of the cap body limiting portion. The ninth connecting bar is disposed on a second side of the cap body limiting portion and is fixedly connected to the second side of the cap body limiting portion.

In one embodiment of the present disclosure, the cap body limiting portion of the hat organizer defines the cap body accommodating space. The cap body accommodating space accommodates the cap body of the at least one baseball cap, and the cap body of the at least one baseball cap is placed in the cap body accommodating space and is limited by the cap body accommodating portion. The radian of the inner surface of the cap body limiting portion is matched with the radian of the outer surface of the dome of the at least one baseball cap, so that the dome of the at least one baseball cap is supported and a shape of the dome maintains an original state when the cap body of the at least one baseball cap is limited in the cap body accommodating space. Therefore, the dome of the at least one baseball cap is kept not deformed.

In another embodiment of the present disclosure, on a basis that the hat organizer comprises the cap body limiting portion, the hat organizer further comprises the brim limiting portion. Specifically, the brim limiting portion of the hat organizer defines the brim accommodating space, and the brim of the at least one baseball cap is placed in the brim accommodating space and is limited by the brim limiting portion. According to the embodiment of the present disclosure, the radian of the inner surface of the brim limiting portion is matched with the radian of the outer surface of the brim of the at least one baseball cap, so that a shape of the brim of the at least baseball cap is kept when the brim of the at least one baseball cap is limited. Therefore, the brim of the at least one baseball cap is kept not deformed.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

For a complete understanding of the present disclosure and its characteristics, the following description will be made in conjunction with the accompanying drawings, where same reference numbers in the following description indicate same structures.

In the drawings.

Figure 1:
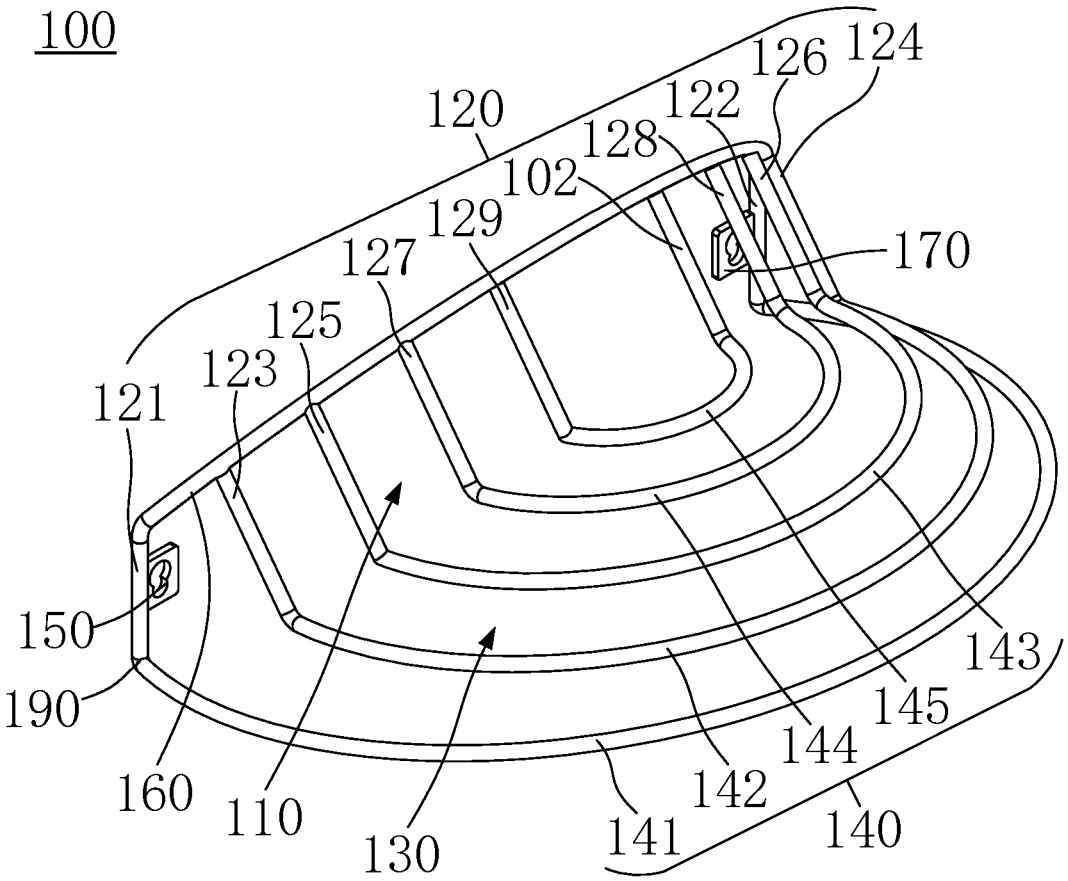
FIG. 1 is a structural schematic diagram of a first hat organizer according to a first embodiment of the present disclosure.

100: first hat organizer; 110: first brim accommodating space; 120: first brim limiting portion; 121: first sub-brim limiting bar; 122: second sub-brim limiting bar; 123: third sub-brim limiting bar; 124: fourth sub-brim limiting bar; 125: fifth sub-brim limiting bar; 126: sixth sub-brim limiting bar; 127: seventh sub-brim limiting bar; 128: eighth sub-brim limiting bar; 129: ninth sub-brim limiting bar; 102: tenth sub-cap-body limiting bar; 130: first cap accommodating space; 140: first cap limiting portion; 141: first sub-cap-body limiting bar; 142: second sub-cap-body limiting bar; 143: third sub-cap-body limiting bar; 144: fourth sub-cap-body limiting bar; 145: fifth sub-cap-body limiting bar; 150: first fixing portion; 160: first connecting bar; 170: second fixing portion; 190: first bending portion;

200: second hat organizer; 210: second cap body accommodating space; 220: second brim limiting portion; 221: first sub-brim limiting bar; 222: second sub-brim limiting bar; 223: third sub-brim limiting bar; 224: fourth sub-brim limiting bar; 225: fifth sub-brim limiting bar; 226: sixth sub-brim limiting bar; 227: seventh sub-brim limiting bar; 228: eighth sub-brim limiting bar; 229: ninth sub-brim limiting bar; 230: second cap body accommodating space; 240: second cap body limiting portion; 241: first sub-cap-body limiting bar; 242: second sub-cap-body limiting bar; 243: third sub-cap-body limiting bar; 244: fourth sub-cap-body limiting bar; 245: fifth sub-cap-body limiting bar; 246: sixth sub-cap-body limiting bar; 247: seventh sub-cap-body limiting bar; 248: eighth sub-cap-body limiting bar; 249: ninth sub-cap-body limiting bar; 250: third fixing portion; 260: second connecting bar; 270: fourth fixing portion; 280: third connecting bar; 290: second bending portion;

300: third hat organizer; 301: hook; 310: third brim accommodating space; 320: third brim limiting portion; 322: third brim limiting bar; 330: third cap body accommodating space; 340: third cap body limiting portion; 342: third cap body limiting bar; 360: fourth connecting bar; 380: fifth connecting bar; 390: third bending portion; 3222: first sub-brim limiting portion; 3224: second sub-brim limiting portion;

400: fourth hat organizer; 410: fourth brim accommodating space; 420: fourth brim limiting portion; 422: first limiting plate; 424: second limiting plate; 426: hollow portion; 430: fourth cap body accommodating space; 440: third cap body limiting portion; 442: first sub-cap-body limiting bar; 444: second sub-cap-body limiting bar; 450: fifth fixing portion; 470: sixth fixing portion; 490: fourth bending part; 4262: baffle plate; 4264: through hole;

500: fifth hat organizer; 530: fifth cap body accommodating space; 540: fifth cap body limiting portion; 541: first sub-cap-body limiting bar; 542: second sub-cap-body limiting bar; 543: third sub-cap-body limiting bar; 544: fourth sub-cap-body limiting bar; 545: fifth sub-cap-body limiting bar; 546: sixth sub-cap-body limiting bar; 547: seventh sub-cap-body limiting bar; 548: eighth sub-cap-body limiting bar; 549: seventh sub-cap-body limiting bar; 548: eighth sub-cap-body limiting bar; 549: ninth sub-cap-body limiting bar; 502: tenth sub-cap-body limiting bar; 504: eleventh sub-cap-body limiting bar; 550: seventh fixing portion; 560: sixth connecting bar; 570: eighth fixing portion; 580: seventh connecting bar;

600: sixth hat organizer; 630: sixth cap body accommodating space; 640: sixth cap body limiting portion; 642: first sub-cap-body limiting bar; 644: second sub-cap-body limiting bar; 646: third sub-cap-body limiting bar; 648: fourth sub-cap-body limiting bar; 650: third sub-cap-body limiting bar; 648: fourth sub-cap-body limiting bar; 650: ninth fixing portion; 660: eighth connecting bar; 670: tenth fixing portion; 680: ninth connecting bar;

X: mounting surface; D1: horizontal direction relative to the mounting surface; D2: Vertical direction relative to the mounting surface.

DETAILED DESCRIPTION

One embodiment of the present disclosure provides a hat organizer configured to support at least one hat, especially at least one baseball cap. That is, the hat organizer is configured to hold and load one or more hats. When the hat organizer of the embodiment of the present disclosure supports the at least one hat such as the at least one baseball cap, the hat organizer effectively limit a cap body of the baseball cap, or the cap body and a brim of the at least one baseball cap, so that a shape of the cap body of the baseball cap keeps unchanged, or shaped of the cap body and the brim of the at least one baseball cap keep unchanged.

The embodiment takes an example that the hat organizer is capable of support the cap body and the brim of the at least one baseball for further illustration.

In the embodiment, the hat organize configured to hold the at least one baseball cap is mounted on a mounting surface of a mounting object. The hat organizer comprises a brim limiting portion, and a cap body limiting portion fixedly connected to the cap body limiting portion.

The hat organizer defines a brim accommodating space and a cap body accommodating space. The brim limiting portion is disposed around the mounting surface of the mounting object to form the brim accommodating space. The cap body limiting portion is disposed around the mounting surface of the mounting object to form the cap body accommodating space. The brim accommodating space is communicated with the cap body accommodating space. A space of the cap body accommodating space is greater than a space of the brim accommodating space.

The brim accommodating space is configured to accommodate a brim of the at least one baseball cap. The cap body accommodating space is configured to accommodate a cap body of the at least one baseball cap.

The brim limiting portion is configured to limit the brim. The brim limiting portion forms an inner surface of the brim accommodating space. A radian of the inner surface of the brim accommodating space is matched with a radian of an outer surface of the brim of the at least one baseball cap. When the brim of the at least one baseball cap is limited in the brim limiting portion, the inner surface of the brim accommodating space prevents the brim of the at least one baseball cap from deformation.

It should be understood that types of hats being supported by the hat organizer in the embodiment of the present disclosure are not limited to baseball caps, and the description herein is mainly made by taking the baseball caps as an example.

It is understood that the radian of the inner surface of the brim accommodating space defined by the brim limiting portion is greater than 0. For instance, if the radian of the outer surface of the brim is A, the radian of the inner surface of the brim accommodating space defined by the brim limiting portion is A or is greater than A. Of course, the radian of the inner surface of the brim accommodating space defined by the brim limiting portion may be 0. For instance, a radian of brims of some hats may be 0, that is, the brims of the hats are flat. In such cases, the radian of the inner surface of the brim accommodating space defined by the brim limiting portion is 0, and the inner surface of the brim accommodating space is flat.

The cap body limiting portion is configured to limit the cap body. The cap body limiting portion forms an inner surface of the cap body accommodating space. A radian of the inner surface of the cap body accommodating space is matched with a radian of an outer surface of a dome of the cap body of the at least one baseball cap. When the cap body of the at least one baseball cap is limited in the cap body limiting portion, the inner surface of the cap body accommodating space prevents the dome of the cap body of the at least one baseball cap from deformation.

The brim limiting portion is inclined relative to the mounting surface of the mounting object. A capacity of the brim accommodating space defined by the brim limiting portion gradually reduces from one end of the brim limiting portion adjacent to the cap body limiting portion to one end of the brim limiting portion away from the cap body limiting portion. In one optional implementation, the brim accommodating space forms a semi-circular-boss-shaped space with the mounting surface.

The cap body limiting portion is inclined relative to the mounting surface of the mounting object. A capacity of the cap body accommodating space defined by the cap body limiting portion gradually increases from one end of the cap body limiting portion adjacent to the brim limiting portion to one end of the cap body limiting portion away from the brim limiting portion. In one optional implementation, the cap body accommodating space forms a hemispherical space with the mounting surface of the mounting object.

In another embodiment, the present disclosure takes an example that the hat organizer is capable of support the cap body of the at least one baseball for further illustration.

The present disclosure further provides a hat organizer configured to hold at least one baseball cap on a mounting surface of a mounting object. The hat organizer comprises a cap body limiting portion. The hat organizer defines a cap body accommodating space. The cap body limiting portion is disposed around the mounting surface of the mounting object to form the cap body accommodating space. The cap body accommodating space is configured to accommodate a cap body of the at least one baseball cap. The cap body limiting portion is configured to limit the cap body. The cap body limiting portion forms an inner surface of the cap body accommodating space. A radian of the inner surface of the cap body accommodating space is matched with a radian of an outer surface of a dome of the cap body of the at least one baseball cap. When the cap body of the at least one baseball cap is limited in the cap body limiting portion, the inner surface of the cap body accommodating space prevents the cap body of the at least one baseball cap from deformation.

The cap body limiting portion is inclined relative to the mounting surface of the mounting object. A capacity of the cap body accommodating space defined by the cap body limiting portion gradually increases from a bottom of the cap body limiting portion to a top of the cap body limiting portion. In one optional implementation, the cap body accommodating space forms a hemispherical space with the mounting surface of the mounting object.

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. The following description of at least one exemplary embodiment is merely illustrative in nature and in no way configures as any limitation to the present disclosure and its application or use based on the embodiments in the present disclosure. Based on the embodiments of the present disclosure, all other embodiments obtained by those of ordinary skill in the art without creative work shall fall within the protection scope of the present disclosure.

Reference herein to "embodiment" means that a particular feature, structure, or characteristic described in connection with one embodiment may be included in at least one embodiment of the present disclosure. The appearances of the "embodiment" in various positions in the specification are not necessarily referring to the same embodiment, and are not independent or alternative embodiments mutually exclusive of other embodiments. Those skilled in the art explicitly and implicitly understand that the embodiments described herein may be combined with other embodiments.

Embodiment 1

Figure 2:
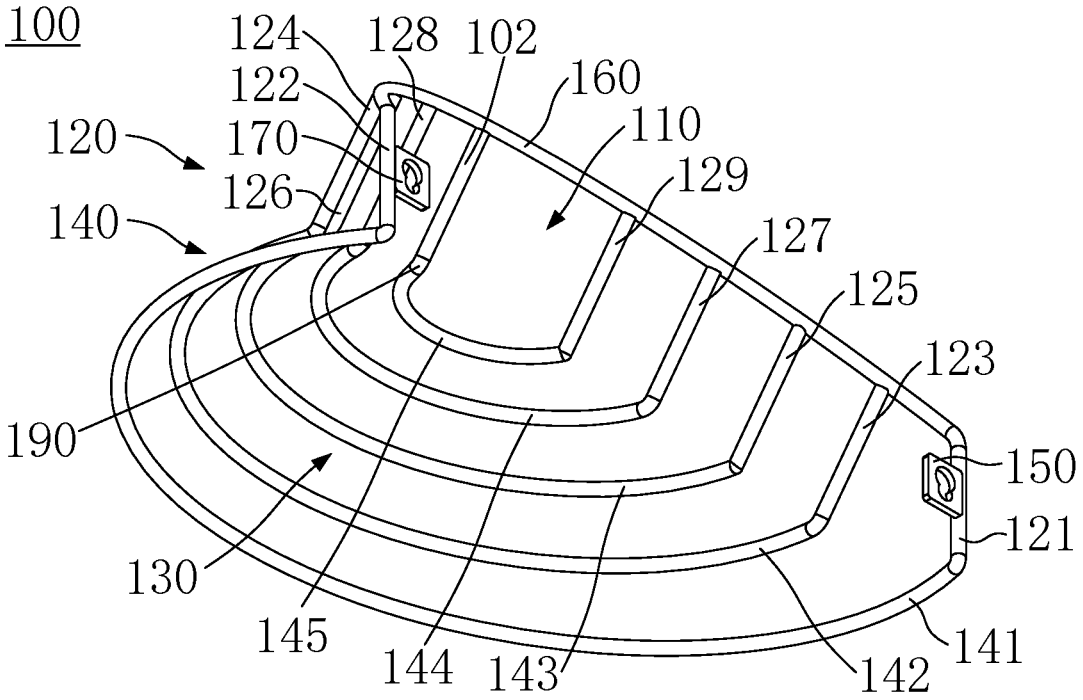
FIG. 2 is another structural schematic diagram of the first hat organizer according to the first embodiment of the present disclosure.
Figure 3:
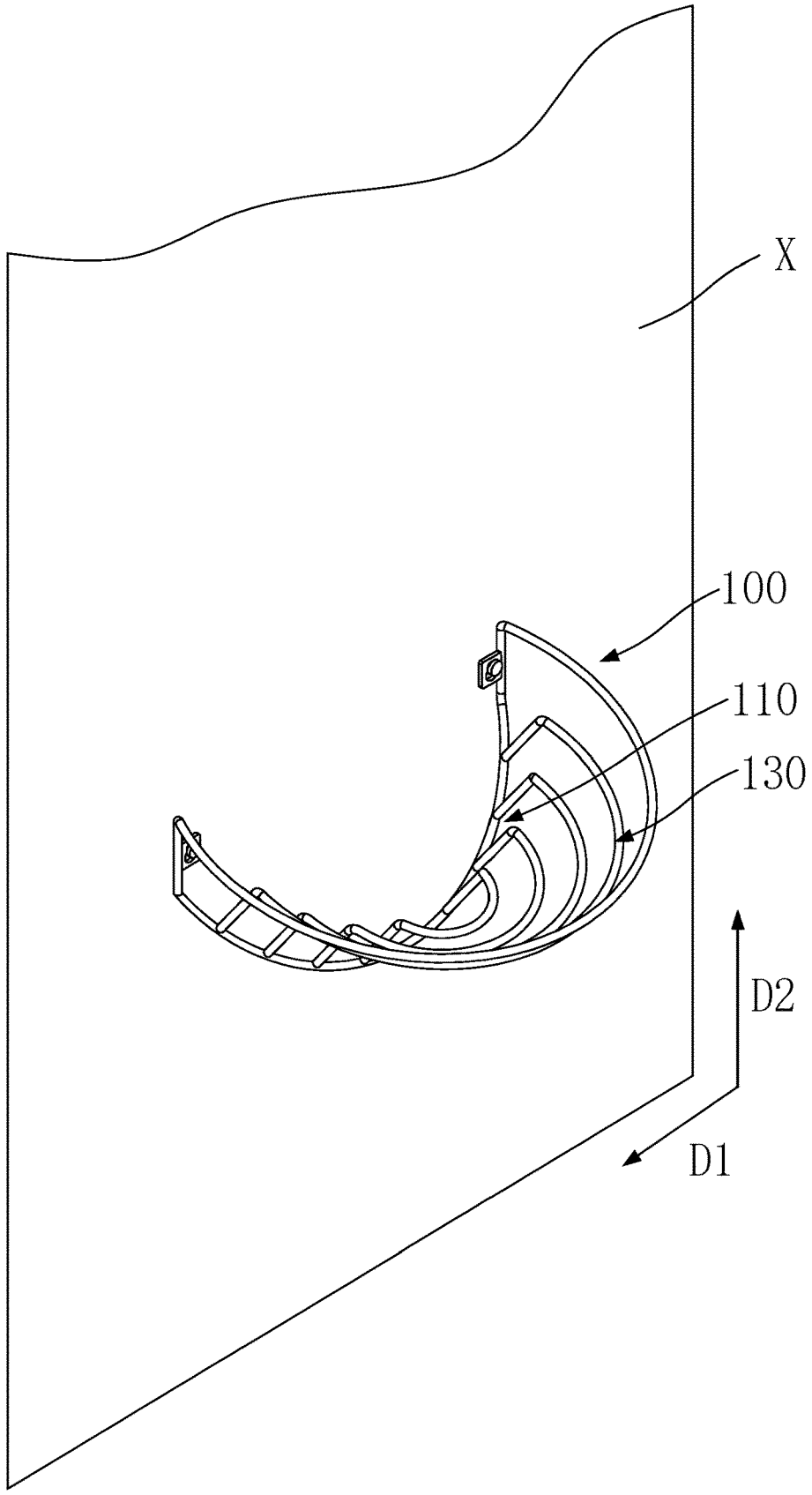
FIG. 3 is a structural schematic diagram of the first hat organizer shown in a configuration of use according to the first embodiment of the present disclosure.

As shown in FIGS. 1-3, FIG. 1 is a structural schematic diagram of a first hat organizer according to a first embodiment of the present disclosure, FIG. 2 is another structural schematic diagram of the first hat organizer according to the first embodiment of the present disclosure, and FIG. 3 is a structural schematic diagram of the first hat organizer shown in a configuration of use according to the first embodiment of the present disclosure. The hat organizer, for instance, the first hat organizer, is configured to hold at least one baseball cap on a mounting surface X of a mounting object. The mounting surface X may be a surface of a wall.

The first hat organizer 100 comprises a brim limiting portion, and a cap body limiting portion. For instance, the brim limiting portion is the first brim limiting portion 120, and the cap body limiting portion is the first cap body limiting portion 140. The first brim limiting portion 120 is fixedly connected to the first cap body limiting portion 140.

The first brim limiting portion 120 is configured to limit the brim of the at least one baseball cap. The first cap body limiting portion 140 is configured to limit the cap body.

The first brim limiting portion 120 comprises a plurality of first brim limiting bars, and the plurality of first brim limiting bars are disposed vertically at intervals relative to the mounting surface X. Specifically, the plurality of first brim limiting bars comprises a first sub-brim limiting bar 121, a second sub-brim limiting bar 122, a third sub-brim limiting bar 123, a fourth sub-brim limiting bar 124, a fifth sub-brim limiting bar 125, a sixth sub-brim limiting bar 126, a seventh sub-brim limiting bar 127, an eighth sub-brim limiting bar 128, a ninth sub-brim limiting bar 129, and a tenth sub-brim limiting bar 102. It should be noted that the number of the plurality of first brim limiting bars is not limited to 10, and may also be other numbers, such as 6, 8, 12, 14, 18, etc. The first sub-brim limiting bar 121 and the second sub-brim limiting bar 122 are disposed on two ends of the first brim limiting portion 120.

In one optional implementation, the first cap body limiting portion 140 comprises a plurality of first cap body limiting bars. The plurality of first cap body limiting bars are transversely disposed at intervals relative to the mounting surface X. Specifically, the first cap body limiting portion 140 comprises a first sub-cap-body limiting bar 141, a second sub-cap-body limiting bar 142, a third sub-cap-body limiting bar 143, a fourth sub-cap-body limiting bar 144, and a fifth sub-cap-body limiting bar 145 disposed at intervals in sequence. It should be noted that the number of the plurality of first cap body limiting bars is not limited to five, and may be other numbers, such as 3, 7, 9, etc.

As shown in FIG. 3, plurality of first cap body limiting bars are transversely disposed at intervals relative to the mounting surface X along a direction D1, and the plurality of first brim limiting bars are vertically disposed at intervals relative to the mounting surface X along a direction D2.

In the embodiment, any one of the plurality of first cap body limiting bars is connected to two of the plurality of first brim limiting bars. Specifically, the first sub-cap-body limiting bar 141 is connected to the first sub-cap-body limiting bar 121 and the second sub-cap-body limiting bar 122. The second sub-cap-body limiting bar 142 is connected to the third sub-cap-body limiting bar 123 and the fourth sub-cap-body limiting bar 124. The third sub-cap-body limiting bar 143 is connected to the fifth sub-cap-body limiting bar 125 and the sixth sub-cap-body limiting bar 126. The fourth sub-cap-body limiting bar 144 is connected to the seventh sub-cap-body limiting bar 127 and the eighth sub-cap-body limiting bar 128. The fifth sub-cap-body limiting bar 145 is connected to the ninth sub-cap-body limiting bar 129 and the tenth sub-cap-body limiting bar 102.

The first hat organizer 100 further comprises a first connecting bar 160. The first connecting bar 160 is disposed on a bottom of the first brim limiting portion 120 and is fixedly connected to the first brim limiting portion 120. An inclination of the first connecting bar 160 relative to the mounting face X of the mounting object is same as an inclination of the first brim limiting portion 120 relative to the mounting face X of the mounting object. Therefore, when the first hat organizer holds and supports the at least one baseball hats, the first brim limiting portion 120 and the first connecting bar 160 prevent the brim from deformation.

The first hat organizer 100 further comprises a first fixing portion 150 and a second fixing portion 170. The first fixing portion 150 is disposed on the first sub-brim limiting bar 121. The second fixing portion 170 is disposed on the second sub-brim limiting bar 122. The first fixing portion 150 and the second fixing portion 170 are configured to mount the first hat organizer 100 on the mounting surface X of the mounting object. A structure of the first fixing portion 150 is same as a structure of the second fixing portion. For instance, the first fixing portion 150 and the second fixing portion 170 are mounted to the mounting surface through a respective screw. Of course, the structure of the first fixing portion 150 may differ from the structure of the second fixing portion, which is not limited thereto.

The first hat organizer 100 further defines the brim accommodating space (e.g., a first brim accommodating space 110). The first brim limiting portion 120 is disposed around the mounting surface X of the mounting object to form the first brim accommodating space 110. The first brim accommodating space is configured to accommodate the brim of the at least one baseball cap. The first brim limiting portion 120 forms an inner surface of the first brim accommodating space 110. A radian of the inner surface of the first brim accommodating space 110 is matched with the radian of the outer surface of the brim of the at least one baseball cap. When the brim of the at least one baseball cap is limited in the first brim limiting portion, the inner surface of the first brim accommodating space 110 prevents the brim of the at least one baseball cap from deformation.

The first hat organizer 100 further defines the cap body accommodating space (e.g., a first cap body accommodating space 130. The first cap body limiting portion 140 is disposed around the mounting surface X of the mounting object to form the first cap body accommodating space 130. The first brim accommodating space is communicated with the first cap body accommodating space. The first cap body limiting portion 140 forms an inner surface of the first cap body accommodating space 130. A radian of the inner surface of the first cap body accommodating space is matched with the radian of the outer surface of the dome of the cap body of the at least one baseball cap. When the cap body of the at least one baseball cap is limited in the first cap body limiting portion, the inner surface of the first cap body accommodating space 130 prevents the dome of the cap body of the at least one baseball cap from deformation.

In one optional implementation, a space of the first cap body accommodating space 130 is greater than a space of the first brim accommodating space 110.

The first brim limiting portion 120 is inclined relative to the mounting surface X of the mounting object. A capacity of the first brim accommodating space 110 defined by the first brim limiting portion 120 gradually reduces from one end of the first brim limiting portion 120 adjacent to the first cap body limiting portion 140 to one end of the first brim limiting portion 120 away from the first cap body limiting portion 140. In one optional implementation, the first brim accommodating space 110 forms a semi-circular-boss-shaped space with the mounting surface X.

The first cap body limiting portion 140 is inclined relative to the mounting surface X of the mounting object. A capacity of the first cap body accommodating space 130 defined by the first cap body limiting portion 140 gradually increases from one end of the first cap body limiting portion 140 adjacent to the first brim limiting portion 120 to one end of the first cap body limiting portion 140 away from the first brim limiting portion 120. In one optional implementation, the first cap body accommodating space 130 forms a hemispherical space with the mounting surface X of the mounting object.

In one optional embodiment of the present disclosure, the first brim limiting portion 120 and the first cap body limiting portion 140 are bent to each other to form a bending portion (i.e., a first bending portion 190) between the first brim limiting portion 120 and the first cap body limiting portion 140. Specifically, the first brim limiting portion 120 and the first cap body limiting portion 140 may be integrally disposed, or may be fixedly connected by welding. For example, two of the plurality of first brim limiting bars and a corresponding one of the plurality of first cap body limiting bar are integrally disposed.

Embodiment 2

Figure 4:
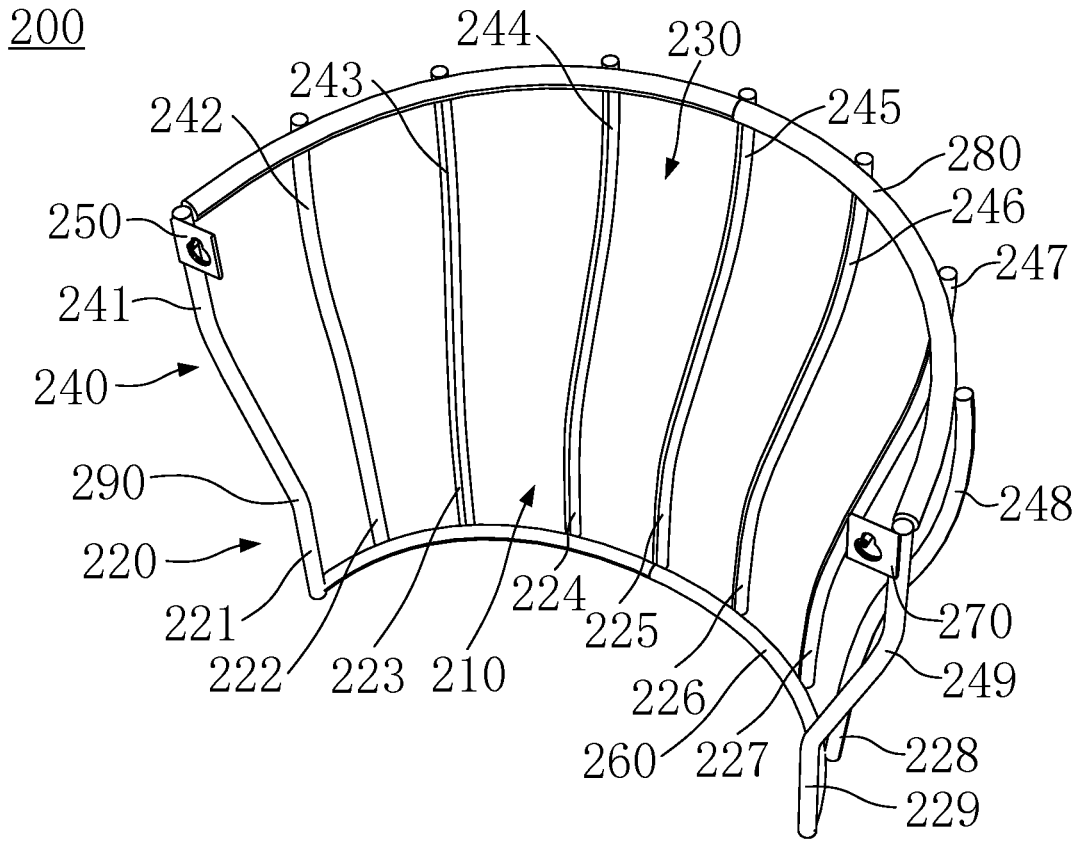
FIG. 4 is a structural schematic diagram of a second hat organizer according to a second embodiment of the present disclosure.

As shown in FIG. 4, FIG. 4 is a structural schematic diagram of a second hat organizer according to a second embodiment of the present disclosure. The hat organizer, for instance, the second hat organizer, comprises a brim limiting portion, and a cap body limiting portion. For instance, the brim limiting portion is a second brim limiting portion 220, and the cap body limiting portion is a second cap body limiting portion 240. The second brim limiting portion 220 is fixedly connected to the second cap body limiting portion 240. The second brim limiting portion 220 is configured to limit the brim of the at least one baseball cap. The second cap body limiting portion 240 is configured to limit the cap body, such as the dome of the at least one baseball cap.

The second brim limiting portion 220 comprises a plurality of second brim limiting bars, and the plurality of second brim limiting bars are vertically disposed at intervals relative to the mounting surface of the mounting object. Specifically, the second brim limiting portion 220 comprises a first sub-brim limiting bar 221, a second sub-brim limiting bar 222, a third sub-brim limiting bar 223, a fourth sub-brim limiting bar 224, a fifth sub-brim limiting bar 225, a sixth sub-brim limiting bar 226, a seventh sub-brim limiting bar 227, an eighth sub-brim limiting bar 228, and a ninth sub-brim limiting bar 229 which are sequentially disposed at intervals. It should be noted that the number of the plurality of second brim limiting bars is not limited to 9, and may also be other numbers, such as 7, 11, etc., which is not limited thereto.

The second cap body limiting portion 240 comprises a plurality of second cap body limiting bars. The plurality of second cap body limiting bars are vertically disposed at intervals relative to the mounting surface X of the mounting object. Specifically, the second cap body limiting portion 240 comprises a first sub-cap-body limiting bar 241, a second sub-cap-body limiting bar 242, a third sub-cap-body limiting bar 243, a fourth sub-cap-body limiting bar 244, a fifth sub-cap-body limiting bar 245, a sixth sub-cap-body limiting bar 246, a seventh sub-cap-body limiting bar 247, an eighth sub-cap-body limiting bar 248, and a ninth sub-cap-body limiting bar 249 which are sequentially disposed at intervals. It should be noted that the number of the plurality of second cap body limiting bars is not limited to 9, and may also be other numbers, such as 7, 11, etc., which is not limited thereto.

In one optional embodiment, any one of the plurality of second cap body limiting bars is connected to one of the plurality of second brim limiting bars.

The first sub-cap-body limiting bar 241 is fixedly connected to the first sub-brim limiting bar 221. The second sub-cap-body limiting bar 242 is fixedly connected to the second sub-brim limiting bar 222. The third sub-cap-body limiting bar 243 is fixedly connected to the third sub-brim limiting bar 223. The fourth sub-cap-body limiting bar 244 is fixedly connected to the fourth sub-brim limiting bar 224. The fifth sub-cap-body limiting bar 245 is fixedly connected to the fifth sub-brim limiting bar 225. The sixth sub-cap-body limiting bar 246 is fixedly connected to the sixth sub-brim limiting bar 226. The seventh sub-cap-body limiting bar 247 is fixedly connected to the seventh sub-brim limiting bar 227. The eighth sub-cap-body limiting bar 248 is fixedly connected to the eighth sub-brim limiting bar 228. The ninth sub-cap-body limiting bar 249 is fixedly connected to the ninth sub-brim limiting bar 229.

The second hat organizer 200 further comprises a second connecting bar 260. The second connecting bar 260 is disposed on a bottom of the second brim limiting portion 220 and is fixedly connected to the second brim limiting portion 220. An inclination of the second connecting bar 260 relative to the mounting face X of the mounting object is same as an inclination of the second brim limiting portion 220 relative to the mounting face X of the mounting object. Therefore, when the second hat organizer 200 supports the at least one baseball cap, the second brim limiting portion 220 and the second connecting bar 260 keep the brim being maintained in an original shape.

The second hat organizer 200 further comprises a third connecting strap 280. The third connecting bar 280 is disposed on a bottom of the second cap body limiting portion 240 and is fixedly connected to the second cap body limiting portion 240. An inclination of the third connecting bar 280 relative to the mounting face X of the mounting object is same as an inclination of the second cap body limiting portion 240 relative to the mounting face X of the mounting object. Therefore, when the second hat organizer 200 supports the at least one baseball cap, the second cap body limiting portion 240 and the third connecting bar 280 keep the cap body being maintained in an original shape.

The second hat organizer 200 further comprises a third fixing portion 250 and a fourth fixing portion 270. The third fixing portion 250 is disposed on the first sub-cap-body limiting bar 241. The fourth fixing portion 270 is disposed on the ninth sub-cap-body limiting bar 249. The third fixing portion 250 and the fourth fixing portion 270 are configured to mount the second hat organizer 200 on the mounting surface X. The third fixing portion 250 and the fourth fixing portion 270 may have same structure or different structures, which is not limited thereto.

The second hat organizer 200 further defines the brim accommodating space (e.g., a second brim accommodating space 210). The second brim limiting portion 220 is disposed around the mounting surface X of the mounting object to form the second brim accommodating space 210. The second brim accommodating space 210 is configured to accommodate the brim of the at least one baseball cap. The second brim limiting portion 220 forms an inner surface of the second brim accommodating space 210. A radian of the inner surface of the second brim accommodating space 210 is matched with the radian of the outer surface of the brim of the at least one baseball cap. When the brim of the at least one baseball cap is limited in the second brim limiting portion 220, the inner surface of the second brim accommodating space 210 prevents the brim of the at least one baseball cap from deformation.

The second hat organizer 200 further defines the cap body accommodating space (e.g., a second cap body accommodating space 230. The second cap body limiting portion 240 is disposed around the mounting surface X of the mounting object to form the second cap body accommodating space 230. The second brim accommodating space 210 is communicated with the second cap body accommodating space. The second cap body limiting portion 240 forms an inner surface of the second cap body accommodating space 230. A radian of the inner surface of the second cap body accommodating space is matched with the radian of the outer surface of the dome of the cap body of the at least one baseball cap. When the cap body of the at least one baseball cap is limited in the second cap body limiting portion 240, the inner surface of the second cap body accommodating space 230 prevents the dome of the cap body of the at least one baseball cap from deformation.

In one optional implementation, a space of the second cap body accommodating space 230 is greater than a space of the second brim accommodating space 210.

The second brim limiting portion 220 is inclined relative to the mounting surface X of the mounting object. A capacity of the second brim accommodating space 210 defined by the second brim limiting portion 220 gradually reduces from one end of the second brim limiting portion 220 adjacent to the second cap body limiting portion 140 to one end of the second brim limiting portion 220 away from the second cap body limiting portion 240. In one optional implementation, the second brim accommodating space 210 form a semi-circular-boss-shaped space with the mounting surface X.

The second cap body limiting portion 240 is inclined relative to the mounting surface X of the mounting object. A capacity of the second cap body accommodating space 230 defined by the second cap body limiting portion 240 gradually increases from one end of the second cap body limiting portion 240 adjacent to the second brim limiting portion 220 to one end of the second cap body limiting portion 240 away from the second brim limiting portion 220. In one optional implementation, the second cap body accommodating space 230 from a hemispherical space with the mounting surface X of the mounting object.

In one optional embodiment of the present disclosure, the second brim limiting portion 220 and the second cap body limiting portion 240 are bent to each other to form a bending portion (i.e., a second bending portion 290) between the second brim limiting portion 220 and the second cap body limiting portion 240. Specifically, the second brim limiting portion 220 and the second cap body limiting portion 240 may be integrally disposed, or may be fixedly connected by welding. For example, one of the plurality of second brim limiting bars and a corresponding one of the plurality of second cap body limiting bar are integrally disposed.

Embodiment 3

Figure 5:
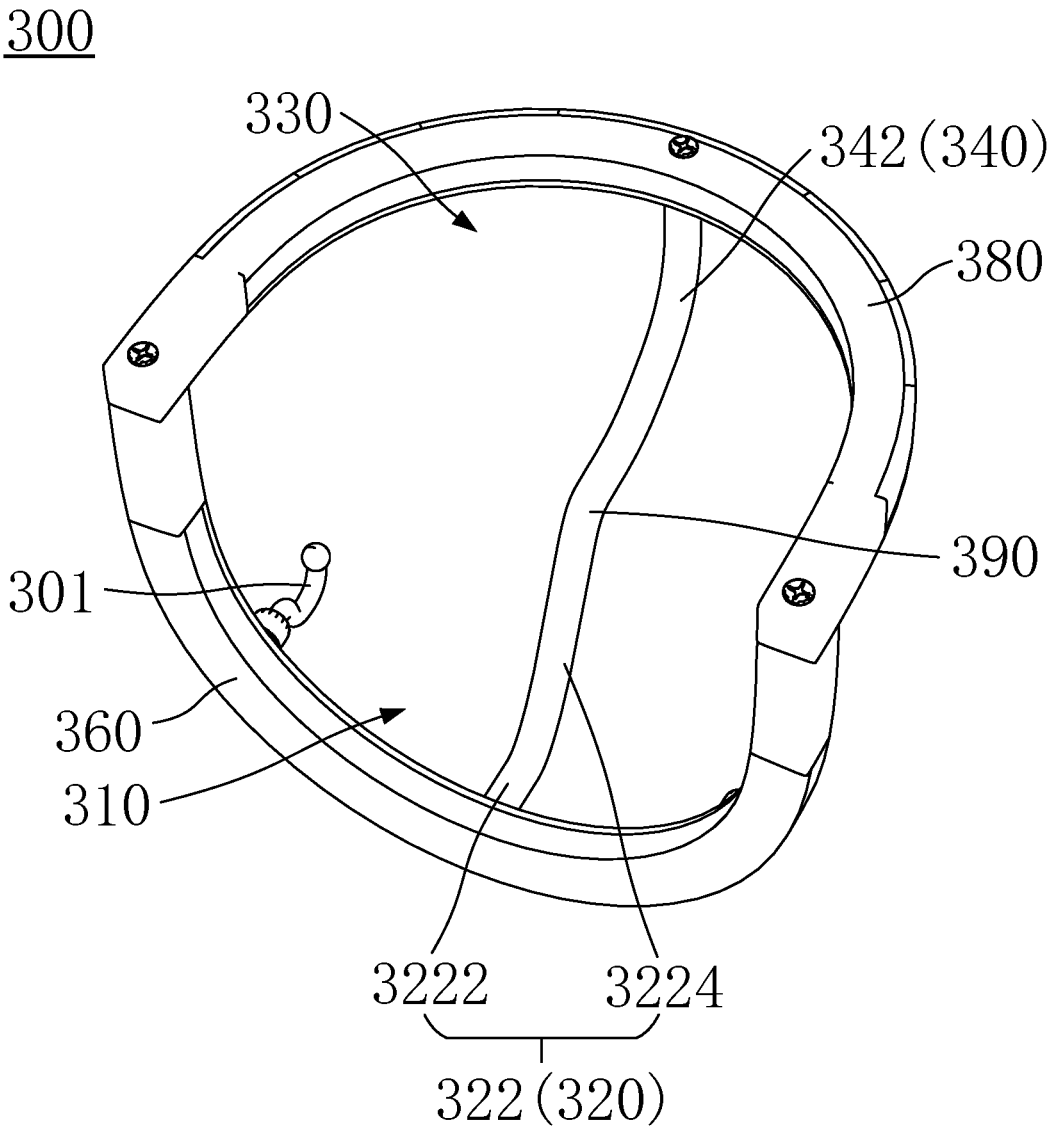
FIG. 5 is a structural schematic diagram of a third hat organizer according to a third embodiment of the present disclosure.

As shown in FIG. 5, FIG. 5 is a structural schematic diagram of a third hat organizer according to a third embodiment of the present disclosure.

The hat organizer, for instance, the third hat organizer 300, comprises a brim limiting portion, and a cap body limiting portion. For instance, the brim limiting portion is a third brim limiting portion 320, and the cap body limiting portion is a third cap body limiting portion 340. The third brim limiting portion 320 is fixedly connected to the third cap body limiting portion 340. The third brim limiting portion 320 is configured to limit the brim of the at least one baseball cap. The third cap body limiting portion 340 is configured to limit the cap body, such as the dome of the at least one baseball cap.

The third brim limiting portion 320 comprises a first sub-brim limiting portion 3222 and a second sub-brim limiting portion 3224. The first sub-brim limiting portion 3222 and the second sub-brim limiting portion 3224 are fixedly connected to each other. The first sub-brim limiting portion 3222 is configured to limit a top end of the brim of the at least one baseball cap. The second sub-brim limiting portion 3224 is configured to limit an outer surface of the brim of the at least one baseball cap. The third brim limiting portion 320 comprises a third brim limiting bar 322, and the third cap body limiting portion 340 comprises a third cap body limiting bar 342.

The third hat organizer 300 further comprises a fourth connecting bar 360 and a fifth connecting bar 380. The fourth connecting bar 360 is parallel to the mounting surface X of the mounting object. The fourth connecting bar 360 is attached to the mounting surface X of the mounting object. The fifth connecting bar is 380 perpendicular to the mounting surface X of the mounting object. The third cap body limiting portion 340 is fixedly connected to the fifth connecting bar 380, and the third cap body limiting portion 340 is connected to a middle of the fifth connecting bar 380.

The first sub-brim limiting portion 3222 and the fourth connecting bar 360 are fixedly connected. The first sub-brim limiting portion 3222 is disposed on a middle of the fourth connecting bar 360. Two ends of the fourth connecting bar 360 are respectively fixedly connected to two ends of the fifth connecting bar 380. The first sub-brim limiting portion is fixedly connected to the cap body limiting portion.

The third hat organizer 300 further comprises one or more hooks such as the hook 301. The hook 301 is configured to hang articles such as keys, ties, belts, etc. The hook 301 may be disposed on the fourth connecting bar 360, and a mounting position of the hook 301 is opposite to a surface of the fourth connecting bar 360 mounted on the mounting surface.

The third hat organizer 300 further defines the brim accommodating space (e.g., a third brim accommodating space 310). The third brim limiting portion 220 is disposed around the mounting surface X of the mounting object to form the third brim accommodating space 210. The third brim accommodating space 310 is configured to accommodate the brim of the at least one baseball cap. The third brim limiting portion 320 forms an inner surface of the third brim accommodating space 310. A radian of the inner surface of the third brim accommodating space 310 is matched with the radian of the outer surface of the brim of the at least one baseball cap. When the brim of the at least one baseball cap is limited in the third brim limiting portion 320, the inner surface of the third brim accommodating space 310 prevents the brim of the at least one baseball cap from deformation.

The third hat organizer 300 further defines the cap body accommodating space (e.g., a third cap body accommodating space 330. The third cap body limiting portion 340 is disposed around the mounting surface X of the mounting object to form the third cap body accommodating space 330. The third brim accommodating space 310 is communicated with the third cap body accommodating space. The third cap body limiting portion 340 forms an inner surface of the third cap body accommodating space 330. A radian of the inner surface of the third cap body accommodating space is matched with the radian of the outer surface of the dome of the cap body of the at least one baseball cap. When the cap body of the at least one baseball cap is limited in the third cap body limiting portion 340, the inner surface of the third cap body accommodating space 330 prevents the dome of the cap body of the at least one baseball cap from deformation.

In one optional implementation, a space of the third cap body accommodating space 330 is greater than a space of the third brim accommodating space 310.

The third brim limiting portion 320 is inclined relative to the mounting surface X of the mounting object. A capacity of the third brim accommodating space 310 defined by the third brim limiting portion 320 gradually reduces from one end of the third brim limiting portion 320 adjacent to the third cap body limiting portion 140 to one end of the third brim limiting portion 320 away from the third cap body limiting portion 340. In one optional implementation, the third brim accommodating space 310 forms a semi-circular-boss-shaped space with the mounting surface X.

The third cap body limiting portion 340 is inclined relative to the mounting surface X of the mounting object. A capacity of the third cap body accommodating space 330 defined by the third cap body limiting portion 340 gradually increases from one end of the third cap body limiting portion 340 adjacent to the third brim limiting portion 320 to one end of the third cap body limiting portion 340 away from the third brim limiting portion 320. In one optional implementation, the third cap body accommodating space 330 forms a hemispherical space with the mounting surface X of the mounting object.

In one optional embodiment of the present disclosure, the third brim limiting portion 320 and the third cap body limiting portion 340 are bent to each other to form a bending portion (i.e., a third bending portion 390) between the third brim limiting portion 320 and the third cap body limiting portion 340. Specifically, the third brim limiting portion 320 and the third cap body limiting portion 340 may be integrally disposed, or may be fixedly connected by welding. For example, the third brim limiting bar 322 and the third cap body limiting bar 342 are integrally disposed.

Embodiment 4

Figure 6:
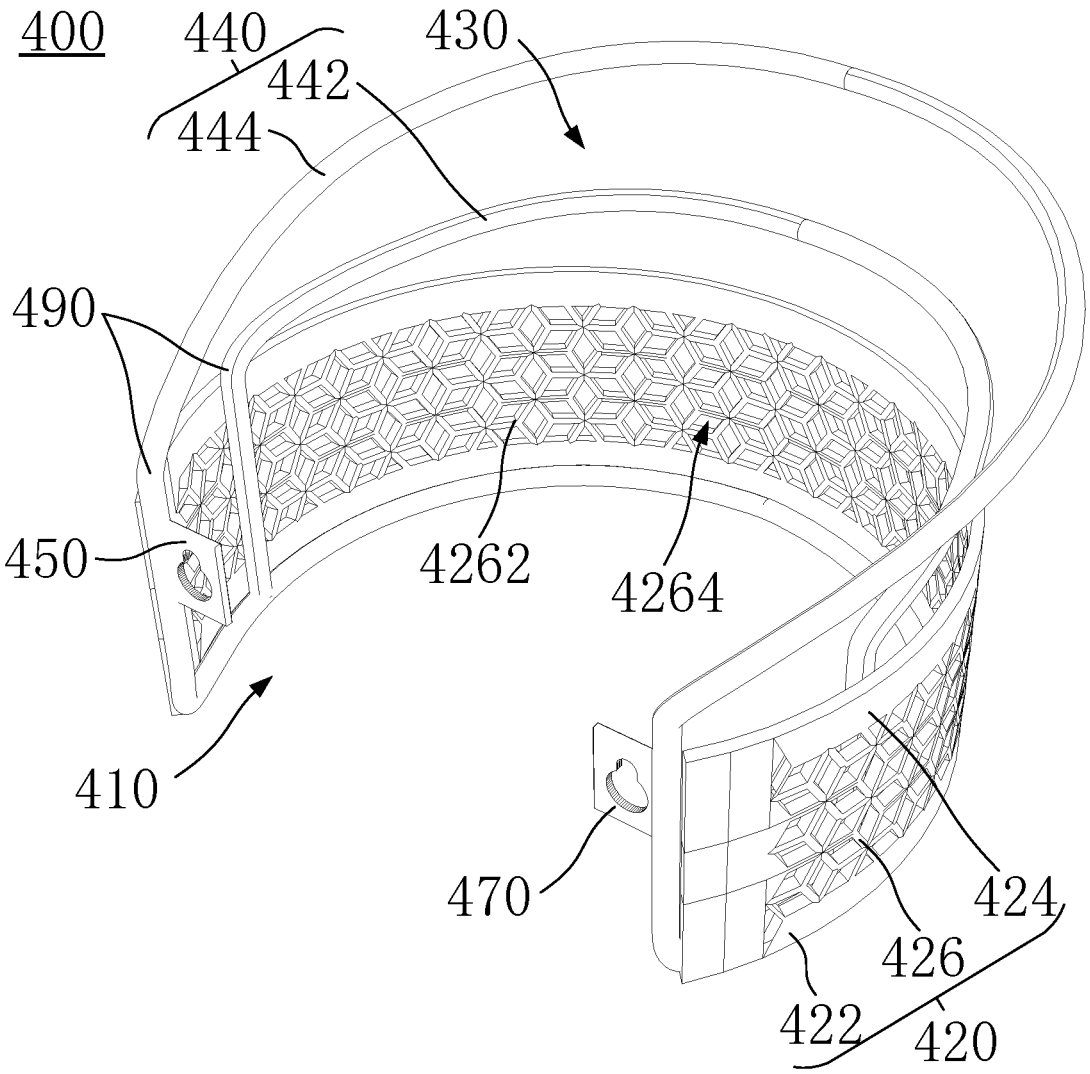
FIG. 6 is a structural schematic diagram of a fourth hat organizer according to a fourth embodiment of the present disclosure.

As shown in FIG. 6, FIG. 6 is a structural schematic diagram of a fourth hat organizer according to a fourth embodiment of the present disclosure.

The hat organizer, for instance, the fourth hat organizer 300, comprises a brim limiting portion, and a cap body limiting portion. For instance, the brim limiting portion is a fourth brim limiting portion 420, and the cap body limiting portion is a fourth cap body limiting portion 440. The fourth brim limiting portion 420 is fixedly connected to the fourth cap body limiting portion 440. The fourth brim limiting portion 420 is configured to limit the brim of the at least one baseball cap. The fourth cap body limiting portion 440 is configured to limit the cap body, such as the dome of the at least one baseball cap.

The at fourth cap body limiting portion 440 comprises a plurality of fourth cap body limiting bars. The plurality of fourth cap body limiting bars are transversely disposed at intervals relative to the mounting surface X of the mounting object. The fourth cap body limiting portion 440 comprises a first sub-cap-body limiting bar 442 and a second sub-cap-body limiting bar 444 disposed at intervals in sequence. It should be noted that the number of the plurality of fourth cap body limiting bars is not limited to two, and may be other numbers, such as 3, 4, etc., which is not limited thereto.

The fourth brim limiting portion 420 comprises a brim limiting plate. A plurality of through holes 4264 spaced apart from each other are defined on the brim liming plate. Specifically, the fourth brim limiting portion 420 comprises a first limiting plate 422, a second limiting plate 424, and a hollow portion 426 disposed between the first limiting plate 422 and the second limiting plate 424. The hollow portion 426 comprises a plurality of baffle plates 4262 and the plurality of through holes 4264 formed by combining the plurality of baffles It should be noted that there may be no through hole defined on the fourth brim limiting portion 420, which is not limited thereto.

The fourth hat organizer 400 further comprises a fifth fixing portion 450 and a sixth fixing portion 470. The fifth fixing portion 450 and the sixth fixing portion 470 are respectively disposed at two ends of the fourth brim limiting portion 420. The fourth brim limiting portion 420 is configured to mount the fourth hat organizer 400 on the mounting surface. The fifth fixing portion 450 and the sixth fixing portion 470 may have a same structure or different structures.

The fourth hat organizer 400 further defines the brim accommodating space (e.g., a fourth brim accommodating space 410). The fourth brim limiting portion 420 is disposed around the mounting surface X of the mounting object to form the fourth brim accommodating space 410. The fourth brim accommodating space 410 is configured to accommodate the brim of the at least one baseball cap. The fourth brim limiting portion 420 forms an inner surface of the fourth brim accommodating space 410. A radian of the inner surface of the fourth brim accommodating space 410 is matched with the radian of the outer surface of the brim of the at least one baseball cap. When the brim of the at least one baseball cap is limited in the fourth brim limiting portion 420, the inner surface of the fourth brim accommodating space 410 prevents the brim of the at least one baseball cap from deformation.

The fourth hat organizer 400 further defines the cap body accommodating space (e.g., a fourth cap body accommodating space 430. The fourth cap body limiting portion 440 is disposed around the mounting surface X of the mounting object to form the fourth cap body accommodating space 430. The fourth brim accommodating space 410 is communicated with the fourth cap body accommodating space. The fourth cap body limiting portion 440 forms an inner surface of the fourth cap body accommodating space 430. A radian of the inner surface of the fourth cap body accommodating space is matched with the radian of the outer surface of the dome of the cap body of the at least one baseball cap. When the cap body of the at least one baseball cap is limited in the fourth cap body limiting portion 440, the inner surface of the fourth cap body accommodating space 430 prevents the dome of the cap body of the at least one baseball cap from deformation.

In one optional implementation, a space of the fourth cap body accommodating space 430 is greater than a space of the fourth brim accommodating space 310.

The fourth cap body limiting portion 440 is inclined relative to the mounting surface X of the mounting object. A capacity of the fourth cap body accommodating space 430 defined by the fourth cap body limiting portion 440 gradually increases from one end of the fourth cap body limiting portion 440 adjacent to the fourth brim limiting portion 420 to one end of the fourth cap body limiting portion 440 away from the fourth brim limiting portion 420. In one optional implementation, the fourth cap body accommodating space 330 forms a semi-cylindrical space with the mounting surface X of the mounting object.

In one optional embodiment of the present disclosure, the fourth brim limiting portion 420 and the fourth cap body limiting portion 440 are bent to each other to form a bending portion (i.e., a fourth bending portion 490) between the fourth brim limiting portion 420 and the fourth cap body limiting portion 440. Specifically, the fourth brim limiting portion 420 and the fourth cap body limiting portion 440 may be fixedly connected by welding.

The above embodiments and corresponding drawings are configured to jointly explain the hat organizer capable of limiting both the cap body and the brim of the at least one baseball cap. The following embodiments and corresponding drawings are jointly to illustrate the hat organizer that only supports and limits the cap body of the at least one baseball cap, especially the dome of the cap body.

Embodiment 5

Figure 7:
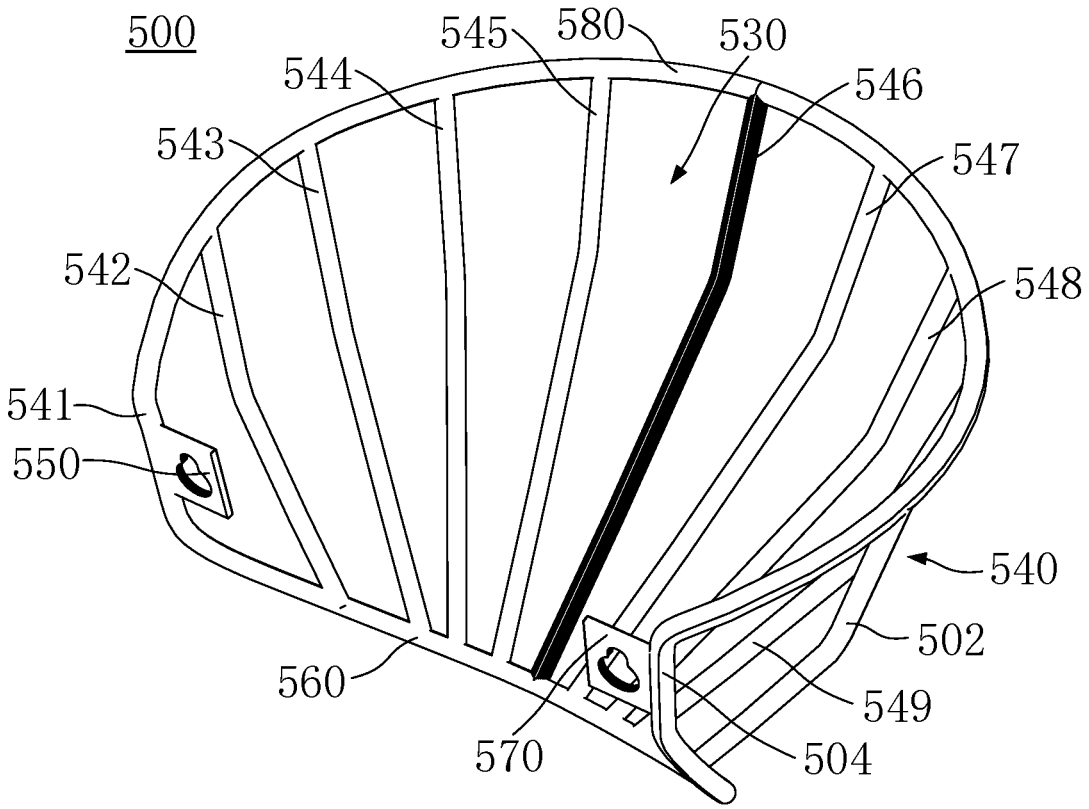
FIG. 7 is a structural schematic diagram of a fifth hat organizer according to a fifth embodiment of the present disclosure.

As shown in FIG. 7, FIG. 7 is a structural schematic diagram of a fifth hat organizer according to a fifth embodiment of the present disclosure.

The hat organizer, such as the fifth hat organizer 500, comprises the cap body limiting portion. The cap body limiting portion is, for instance, a fifth cap body limiting portion 540. The fifth cap body limiting portion 540 is configured to limit the cap body, such as the dome of the at least one baseball cap.

The fifth cap body limiting portion 540 comprises a plurality of fifth cap body limiting bars. The plurality of fifth cap body limiting bars are vertically disposed at intervals relative to the mounting surface of the mounting object. The fifth cap body limiting portion 540 comprises a first sub-cap-body limiting bar 541, a second sub-cap-body limiting bar 542, a third-sub-cap-body limiting bar 543, a fourth sub-cap-body limiting bar 544, a fifth sub-cap-body limiting bar 545, a sixth sub-cap-body limiting bar 546, a seventh sub-cap-body limiting bar 547, a ninth sub-cap-body limiting bar 549, a tenth sub-cap-body limiting bar 502, and an eleventh cap body limiting bar 504 which are sequentially disposed at intervals It should be noted that the number of the plurality of fifth cap body limiting bars is not limited to 11, and may also be other numbers, such as 9, 13, etc., which is not limited thereto.

A cross section of the sixth sub-cap limiting bar 546 disposed on a middle of the fifth cap body limiting portion 540 is greater than a cross section of other sub-cap-body limiting bars of the plurality of fifth cap body limiting bars.

The fifth hat organizer 500 further comprises a sixth connecting bar 560 and a seventh connecting bar 580. The sixth connecting bar 560 is disposed on the bottom of the fifth cap body limiting portion 540 and is fixedly connected to the fifth cap body limiting portion. The seventh connecting bar 580 is disposed on the top of the fifth cap body limiting portion 540 and is fixedly connected to the fifth cap body limiting portion 540.

The fifth hat organizer 500 further comprises a seventh fixing portion 550 and an eighth fixing portion 570. The seventh fixing portion 550 is disposed on the first sub-cap-body limiting bar 541, and the eighth fixing portion 570 is disposed on the eleventh sub-cap-body limiting bar 504. The seventh fixing portion 550 and the eighth fixing portion 570 are configured to mount the fifth hat organizer 500 on the mounting surface. The seventh fixing portion 550 and the eighth fixing portion 570 may have a same structure or different structures.

The fifth hat organizer 500 further defines the cap body accommodating space (e.g., a fifth cap body accommodating space 530. The fifth cap body limiting portion 540 is disposed around the mounting surface X of the mounting object to form the fifth cap body accommodating space 530. The fifth cap body limiting portion 540 forms an inner surface of the fifth cap body accommodating space 530. A radian of the fifth inner surface of the fifth cap body accommodating space is matched with the radian of the outer surface of the dome of the cap body of the at least one baseball cap. When the cap body of the at least one baseball cap is limited in the fifth cap body limiting portion 440, the fifth inner surface of the fifth cap body accommodating space 530 prevents the dome of the cap body of the at least one baseball cap from deformation.

The fifth cap body limiting portion 540 is inclined relative to the mounting surface X of the mounting object. A capacity of the fifth cap body accommodating space 530 defined by the fifth cap body limiting portion 440 gradually increases from a bottom of the fifth cap body limiting portion 540 to a top of the fifth cap body limiting portion 540. In one optional implementation, the fifth cap body accommodating space 330 forms a hemispherical space with the mounting surface X of the mounting object.

Embodiment 6

Figure 8:
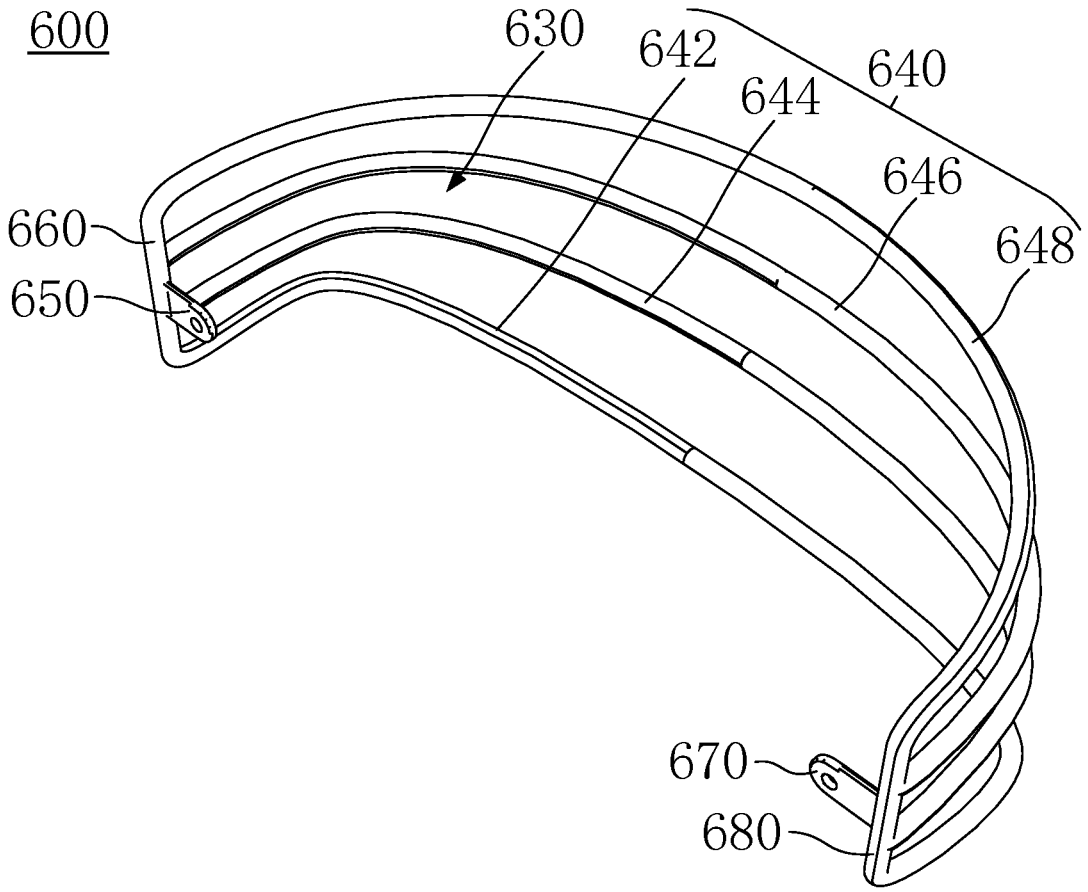
FIG. 8 is a structural schematic diagram of a sixth hat organizer according to a sixth embodiment of the present disclosure.

As shown in FIG. 8, FIG. 8 is a structural schematic diagram of a sixth hat organizer according to a sixth embodiment of the present disclosure.

The hat organizer, such as the sixth hat organizer 600, comprises the cap body limiting portion. The cap body limiting portion is, for instance, a sixth cap body limiting portion 640. The sixth cap body limiting portion 640 is configured to limit the cap body, such as the dome of the at least one baseball cap.

The sixth cap body limiting portion 640 comprises a plurality of sixth cap body limiting bars. The plurality of sixth cap body limiting bars are transversely disposed at intervals relative to the mounting surface of the mounting object. The sixth cap body limiting portion 640 comprises a first sub-cap-body limiting bar 641, a second sub-cap-body limiting bar 642, a third-sub-cap-body limiting bar 643, and a fourth sub-cap-body limiting bar 644, which are sequentially disposed at intervals It should be noted that the number of the plurality of sixth cap body limiting bars is not limited to 4, and may also be other numbers, such as 3, 5, 6, 8, etc., which is not limited thereto.

The sixth hat organizer 600 further comprises an eighth connecting bar 660 and a ninth connecting bar 680. The eighth connecting bar 660 is disposed on a first side of the sixth cap body limiting portion 640 and is fixedly connected to the first side of the sixth cap body limiting portion 640. The ninth connecting bar is disposed on a second side of the sixth cap body limiting portion 640 and is fixedly connected to the second side of the sixth cap body limiting portion 640.

The sixth hat organizer 600 further comprises a ninth fixing portion 650 and a tenth fixing portion 670. The ninth fixing portion 650 is disposed on the eighth connecting bar 660, and the tenth fixing portion 670 is disposed on the ninth connecting bar 680. The ninth fixing portion 650 and the tenth fixing portion 670 are configured to mount the sixth hat organizer 500 on the mounting surface. The ninth fixing portion 650 and the tenth fixing portion 670 may have a same structure or different structures.

The above embodiments of the present disclosure provide a detailed illustration to the hat organizer. In the present disclosure, specific embodiments are applied to illustrate the principles and implementations of the present disclosure. The above description of the embodiments is only used to better understand methods and core ideas of the present disclosure. Meanwhile, according to the ideas of the present disclosure, changes are made in the specific implementations and the application scope by those skilled in the art. Therefore, the contents of the specification should not be regarded as a limitation of the present disclosure.

What is claimed is:

1. A hat organizer configured to hold at least one baseball cap on a mounting surface of a mounting object, comprising:

a brim limiting portion, and a cap body limiting portion fixedly connected to the brim limiting portion;

wherein the hat organizer defines a brim accommodating space and a cap body accommodating space; the brim limiting portion is disposed around the mounting surface of the mounting object to form the brim accommodating space; the cap body limiting portion is disposed around the mounting surface of the mounting object to form the cap body accommodating space; the brim accommodating space is communicated with the cap body accommodating space; a space of the cap body accommodating space is greater than a space of the brim accommodating space;

wherein the brim accommodating space is configured to accommodate a brim of the at least one baseball cap; the cap body accommodating space is configured to accommodate a cap body of the at least one baseball cap;

wherein the brim limiting portion is configured to restrain the brim; the brim limiting portion forms an inner surface of the brim accommodating space; a radian of the inner surface of the brim accommodating space is matched with a radian of an outer surface of the brim of the at least one baseball cap; when the brim of the at least one baseball cap is restrained in the brim limiting portion, the inner surface of the brim accommodating space prevents the brim of the at least one baseball cap from deformation; and wherein the cap body limiting portion is configured to restrain the cap body; the cap body limiting portion forms an inner surface of the cap body accommodating space; a radian of the inner surface of the cap body accommodating space is matched with a radian of an outer surface of a dome of the cap body of the at least one baseball cap; when the cap body of the at least one baseball cap is restrained in the cap body limiting portion, the inner surface of the cap body accommodating space prevents the dome of the cap body of the at least one baseball cap from deformation;

wherein the cap body limiting portion is inclined relative to the mounting surface of the mounting object; a capacity of the cap body accommodating space defined by the cap body limiting portion gradually increases from one end of the cap body limiting portion adjacent to the brim limiting portion to one end of the cap body limiting portion away from the brim limiting portion;

wherein the brim accommodating space forms a semi-cylindrical space with the mounting surface of the mounting object; the cap body accommodating space forms a hemispherical space with the mounting surface of the mounting object.

2. The hat organizer according to claim 1, wherein the brim limiting portion is inclined relative to the mounting surface of the mounting object; a capacity of the brim accommodating space defined by the brim limiting portion gradually reduces from one end of the brim limiting portion adjacent to the cap body limiting portion to one end of the brim limiting portion away from the cap body limiting portion.

3. The hat organizer according to claim 2, wherein the cap body limiting portion comprises a plurality of first cap body limiting bars; the plurality of first cap body limiting bars are transversely disposed at intervals relative to the mounting surface of the mounting object;

wherein the brim limiting portion comprises a plurality of first brim limiting bars; the plurality of first brim limiting bars are vertically disposed at intervals relative to the mounting surface of the mounting object.

4. The hat organizer according to claim 3, wherein any one of the plurality of first cap body limiting bars is connected to two of the plurality of first brim limiting bars.

5. The hat organizer according to claim 3, wherein the hat organizer further comprises a first connecting bar; the first connecting bar is disposed on a bottom of the brim limiting portion and is fixedly connected to the brim limiting portion; an inclination of the first connecting bar relative to the mounting face of the mounting object is same as an inclination of the brim limiting portion relative to the mounting face of the mounting object.

6. The hat organizer according to claim 5, wherein the plurality of first brim limiting bars comprise a first sub-brim limiting bar and a second sub-brim limiting bar; the first sub-brim limiting bar and the second sub-brim limiting bar are respectively disposed on two ends of the brim limiting portion;

wherein the hat organizer further comprises a first fixing portion and a second fixing portion; the first fixing portion is disposed on the first sub-brim limiting bar; the second fixing portion is disposed on the second sub-brim limiting bar; the first fixing portion and the second fixing portion are configured to mount the hat organizer on the mounting surface of the mounting object.

7. The hat organizer according to claim 2, wherein the cap body limiting portion comprises a plurality of second cap body limiting bars; the plurality of second cap body limiting bars are vertically disposed at intervals relative to the mounting surface of the mounting object;

wherein the brim limiting portion comprises a plurality of second brim limiting bars; the plurality of second brim limiting bars are vertically disposed at intervals relative to the mounting surface of the mounting object.

8. The hat organizer according to claim 7, wherein any one of the plurality of second cap body limiting bars is connected to one of the plurality of second brim limiting bars;

wherein the hat organizer further comprises a second connecting bar and a third connecting strap; the second connecting bar is disposed on a bottom of the brim limiting portion and is fixedly connected to the brim limiting portion; an inclination of the second connecting bar relative to the mounting face of the mounting object is same as an inclination of the brim limiting portion relative to the mounting face of the mounting object;

wherein the third connecting bar is disposed on a bottom of the cap body limiting portion and is fixedly connected to the cap body limiting portion; an inclination of the third connecting bar relative to the mounting face of the mounting object is same as an inclination of the cap body limiting portion relative to the mounting face of the mounting object.

9. The hat organizer according to claim 2, wherein the brim limiting portion comprises a first sub-brim limiting portion and a second sub-brim limiting portion; the first sub-brim limiting portion and the second sub-brim limiting portion are fixedly connected to each other, the first sub-brim limiting portion is configured to limit a top end of the brim of the at least one baseball cap; the second sub-brim limiting portion is configured to limit an outer surface of the brim of the at least one baseball cap;

wherein the second sub-brim limiting portion is fixedly connected to the cap body limiting portion.

10. The hat organizer according to claim 9, wherein the brim limiting portion comprises a third brim limiting bar, and the cap body limiting portion comprises a third cap body limiting bar;

wherein the hat organizer further comprises a fourth connecting bar and a fifth connecting bar; the fourth connecting bar is parallel to the mounting surface of the mounting object; the fourth connecting bar is attached to the mounting surface of the mounting object; the fifth connecting bar is perpendicular to the mounting surface of the mounting object; the cap body limiting portion is fixedly connected to the fifth connecting bar; and the cap body limiting portion is connected to a middle of the fifth connecting bar;

wherein the first sub-brim limiting portion is fixedly connected to the fourth connecting bar; the first sub-brim limiting portion is disposed on a middle of the fourth connecting bar; two ends of the fourth connecting bar are fixedly connected to two ends of the fifth connecting bar.

11. The hat organizer according to claim 1, wherein the cap body limiting portion comprises a plurality of fourth cap body limiting bars; the plurality of fourth cap body limiting bars are transversely disposed at intervals relative to the mounting surface of the mounting object; the brim limiting portion comprises a brim limiting plate;

wherein a plurality of through holes spaced apart from each other are defined on the brim liming plate, or no through hole is defined on the brim liming plate.

12. A hat organizer configured to hold at least one baseball cap on a mounting surface of a mounting object, comprising: a cap body limiting portion;

wherein the hat organizer defines a cap body accommodating space; the cap body limiting portion is disposed around the mounting surface of the mounting object to form the cap body accommodating space; the cap body accommodating space is configured to accommodate a cap body of the at least one baseball cap;

wherein the cap body limiting portion is configured to restrain the cap body;

the cap body limiting portion forms an inner surface of the cap body accommodating space; a radian of the inner surface of the cap body accommodating space is matched with a radian of an outer surface of a dome of the cap body of the at least one baseball cap; when the cap body of the at least one baseball cap is restrained in the cap body limiting portion, the inner surface of the cap body accommodating space prevents the cap body of the at least one baseball cap from deformation;

wherein the cap body limiting portion is inclined relative to the mounting surface of the mounting object; a capacity of the cap body accommodating space defined by the cap body limiting portion gradually increases from a bottom of the cap body limiting portion to a top of the cap body limiting portion;

wherein the cap body accommodating space forms a hemispherical space with the mounting surface of the mounting object.

13. The hat organizer according to claim 12, wherein the cap body limiting portion comprises a plurality of fifth cap body limiting bars; the plurality of fifth cap body limiting bars are vertically disposed at intervals relative to the mounting surface of the mounting object;

wherein the hat organizer further comprises a sixth connecting bar and a seventh connecting bar; the sixth connecting bar is disposed on the bottom of the cap body limiting portion and is fixedly connected to the cap body limiting portion; the seventh connecting bar is disposed on the top of the cap body limiting portion and is fixedly connected to the cap body limiting portion.

14. The hat organizer according to claim 12, wherein the cap body limiting portion comprises a plurality of sixth cap body limiting bars; the plurality of sixth cap body limiting bars are transversely disposed at intervals relative to the mounting surface of the mounting object;

wherein the hat organizer further comprises an eighth connecting bar and a ninth connecting bar; the eighth connecting bar is disposed on a first side of the cap body limiting portion and is fixedly connected to the first side of the cap body limiting portion; the ninth connecting bar is disposed on a second side of the cap body limiting portion and is fixedly connected to the second side of the cap body limiting portion.

* * * * *